United States Patent [19]

Komuro

[11] Patent Number: 4,825,530

[45] Date of Patent: May 2, 1989

[54] ELECTRICAL CONNECTOR APPLICATOR

[75] Inventor: Katsumi Komuro, Tokyo, Japan

[73] Assignee: AMP Incorporated, Harrisburg, Pa.

[21] Appl. No.: 162,776

[22] Filed: Mar. 1, 1988

[30] Foreign Application Priority Data

Apr. 28, 1987 [JP] Japan ..... 62-106180

[51] Int. Cl.[4] ..... H01R 43/04

[52] U.S. Cl. ..... 29/566.3; 29/749; 29/751; 29/753

[58] Field of Search ..... 29/749, 748, 751, 753, 29/747, 566.3, 566.4

[56] References Cited

U.S. PATENT DOCUMENTS

| | | | |
|---|---|---|---|
| 3,758,935 | 9/1973 | Long et al. . | |
| 3,803,695 | 4/1974 | Tucci . | |
| 3,845,535 | 11/1974 | Over . | |
| 3,859,724 | 1/1975 | Folkenroth . | |
| 3,866,295 | 2/1975 | Tucci . | |
| 3,866,297 | 2/1975 | Aldridge et al. . | |
| 3,972,101 | 8/1976 | Casey et al. | 29/749 |
| 4,110,896 | 9/1978 | Roiko | 29/566.3 X |
| 4,148,138 | 4/1979 | Becker et al. | 29/749 |
| 4,332,083 | 6/1982 | Johnson, Jr. et al. . | |
| 4,349,944 | 9/1982 | Fickes . | |

*Primary Examiner*—Carl E. Hall

*Attorney, Agent, or Firm*—William B. Noll

[57] ABSTRACT

An electrical connector applicator comprises a lower holding-member (1) on a base (3) for holding a base member (19) of an electrical connector so that electrical conductors (18) of a cable (17) can be positioned along the base member (19) and an upper holding-member (2) on a block (10) for holding a cover member (16) of the electrical connector. A section (10*a*) of block (10) is pivotally mounted to a spring-biased mechanism (6, 7, 8, 9, 11) located on base (3). A handle (12) has its free ends pivotally mounted to plates (4) on base (3) and block (10) is pivotally mounted to arm (13) of handle (12) so that when handle (12) is in an upper position, cover member (16) and base member (19) can be easily mounted in upper and lower holding-members (2, 1) and conductors (18) can be positioned along base member (19), and, when handle (12) is moved to a lower position, cover member (16) is positioned parallel to base member (19) and is pressed onto base member (19) thereby terminating conductors (18) to electrical contacts in the electrical connector.

6 Claims, 3 Drawing Sheets

ELECTRICAL CONNECTOR APPLICATOR

FIELD OF THE INVENTION

This invention is related to an electrical connector applicator for connecting electrical conductors to electrical contacts of an electrical connector thereby forming an electrical connector assembly.

BACKGROUND OF THE INVENTION

A known applicator, which comprises a die-set attached to the main body of a press by a toggle or a rack gear, has been used for connecting electrical conductors to an electrical connector. However, a connector or the conductors must be set in the die-set of the applicator, and this is limited by the way in which a lower section of the die-set is withdrawn, for example, along a rail. Also a tool for arranging the conductors is necessary when they are arranged in a detachable type of lower section of the die-set; therefore, a disadvantage arises of a possible mispositioning of the conductors when the tool is removed. Further, when the conductors of a cable are to be arranged for termination in the connector, the operation is difficult because the arrangement of the conductors must be conducted by placing an operator's hand into a very small space.

In consideration of the above-mentioned problems, the purpose of this invention is to provide an electrical connector applicator, which is both highly efficient and low in price, and enables members of the electrical connector to be easily and accurately fitted on the upper and lower sections of the applicator and conductors terminated thereto quickly and firmly, thus ensuring that a high-quality electrical connector assembly is produced.

SUMMARY OF THE INVENTION

In the electrical connector applicator according to the present invention before the operation thereof, a base member and a cover member of an electrical connector are mounted on upper and lower sections of an applicator which are positioned at approximately 90 degrees. This enables the connector members to be fully visible. Electrical conductors are precisely positioned on the upper and lower sections, then positioned on the base member where a pressing operation is carried out by simply pressing down a lever to bring the upper and lower sections together, while keeping both sections parallel with each other thereby pressing the cover member onto the base member and connecting the conductors to respective electrical contacts of the connector.

BRIEF DESCRIPTION OF THE DRAWINGS

The invention will now be decribed by way of example with reference to the following detailed description of the invention in conjunction with the accompanying drawings of which.

DETAILED DESCRIPTION OF THE INVENTION

Figure 1:
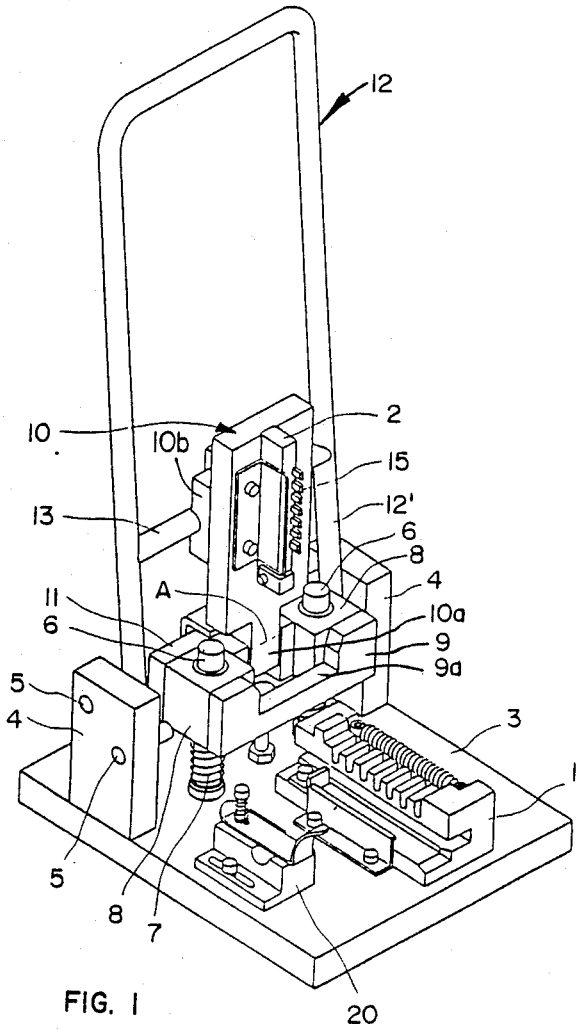
FIG. 1 is a perspective view of an elelectrical connector applicator according to the present invention.
Figure 2:
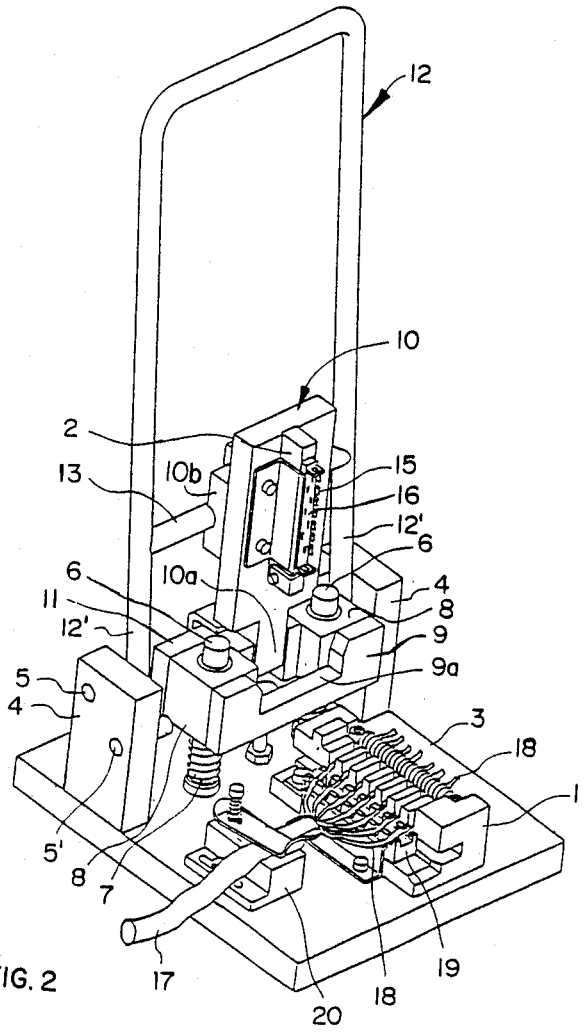
FIG. 2 is a perspective view of the applicator of FIG. 1 showing the condition thereof just before operating the applicator wherein an upper section and a lower section are positioned at an angle of 90 degrees and electrical conductors of a cable are positioned in a base member of an electrical connector.

In a preferred embodiment of the electrical connector applicator according to the present invention, an electrical connector assembly is manufactured by terminating insulated electrical conductors of a cable 17 (as shown in FIG. 2) to an electrical connector which is comprised of a base member 19 and a cover member 16. The main portion of the applicator is composed of a lower section 1 and an upper section 2 and a mechanism for engaging sections 1 and 2.

Lower section 1 is fixed on a base 3, which supports and positions base member 19 of the electrical connector which includes conventional electrical contacts (not shown) that are to be electrically connected to insulated electrical conductors 18 exposed from an insulation jacket of cable 17.

Upper section 2 is movable and is provided with a cutter blade 15 (FIG. 2) for cutting conductors 18. Upper section 2 also holds cover member 16 of the electrical connector. When engaged with lower section 1, cover member 16 is pressed against base member 19 to force respective electrical conductors 18 into the terminating sections of the electrical contacts, and latch cover member 16 to base member 19. At the same time, conductors 18 are cut to a specified length by cutter blade 15. Upper section 2 is fixed to block 10 which is pivotally linked with an arm 13 of an operating handle 12.

Figure 3:
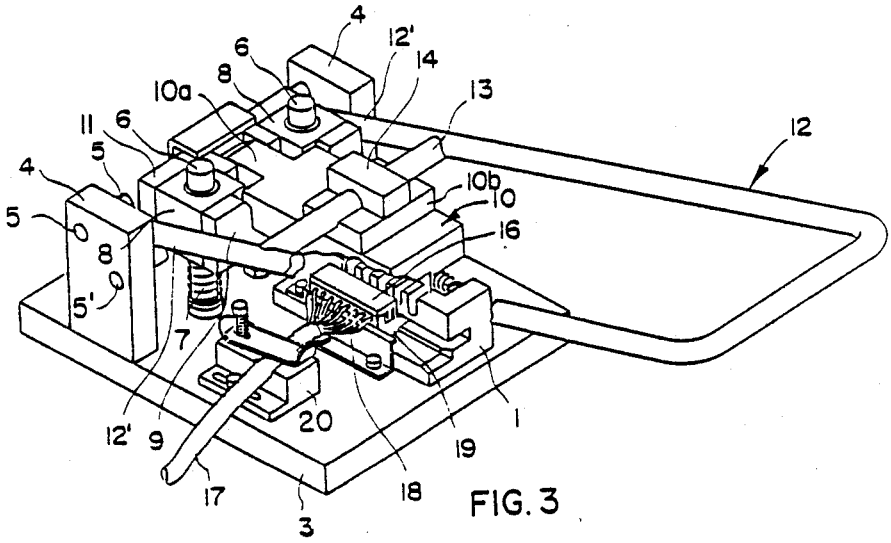
FIG. 3 is a perspective view of the applicator in an operated condition wherein the upper section and the lower section are parallel to each other.

The mechanism for engaging sections 1 and 2 is as follows: Side plates 4 opposed to each other are fixed at both sides of base 3, and two pins 5,5' respectively project in the lateral direction from each of side plates 4. Legs 12' are located below arm 13 of handle 12 and able to move between pins 5,5', as shown in FIG. 3. Two guide posts 6 project vertically from base 3 between side plates 4 and movable blocks 8 are springably and slidably mounted thereon. A compression spring 7 is mounted on each guide post 6 between base 3 and each movable block 8. Thus, movable blocks 8 are supported and resiliently forced upward. The front portions of movable blocks 8 are linked via a front linkage member 9 and the rear portions thereof are linked via a rear linkage member 11. One end **10*a* of block 10 is mounted between movable blocks 8 and is pivotable about an axis A. As explained previously, arm 13 of operating handle 12 is fitted between section 10*b* of block 10 and plate 14 (FIG. 3). Also, a fixing device 20 for fixing cable 17 in position is mounted on base 3**.

The operation of the electrical connector applicator according to this invention is explained as follows:

Base member 19 of the connector is fixed to lower section 1 when both sections 1 and 2 are in the open positon, as shown in FIG. 2, and cable 17 is fixed on base 3 via fixing device 20. At this time, a specified length of insulation at the end of cable 17 is removed and conductors 18 are exposed. Conductors 18 are placed on base member 19 in alignment with respective termination sections of the electrical contacts and with the ends thereof projecting beyond lower section 1. Cover member 16 of the connector is then fixed on upper section 2.

The arrangement of cover member 16 along upper section 2, base member 19 along lower section 1 and conductors 18 along base member 19 is now completed as shown in FIG. 2. The applicator is now ready for operation to terminate conductors 18 to the electrical contacts and to latch cover member 16 to base member 19.

Upper holding-member 2 and lower holding-member 1 are first brought substantially parallel to each other by pulling down handle 12, and then handle 12 is further pulled down and section 10*a* of block 10 is engaged with the upper surface of linkage member 9. Upper holding-member 2 is guided by guide posts 6 and is moved down vertically against the force of springs 7 thereby engaging lower holding-member 1. Handle 12 thus functions as a lever. As explained above, the pessing operation by upper holding-member 2 is a parallel movement, such that the engaging faces of the upper and lower holding-members are in parallel, and the operation for mating cover member 16 with the base member 19 thereby terminating conductors 18 is a pivoting movement. Accordingly, by the above operation, ends of conductors 18 extending beyond the connector are cut by cutter blade 15, conductors 18 are press-fitted into the slotted termination sections of the contacts of the connector, and the contacts are electrically connected with the conductor cores by penetrating the insulation of conductors 18.

As a result of the electrical connector applicator according to this invention as explained above, members of an electrical connector and electrical conductors to be terminated therein can be easily and accurately fitted together when an upper holding-member and a lower holding-member are positioned approximately at a right angle to each other. More particularly, a cover member of the electrical connector can be set precisely in position. Also, it is not necessary to insert and withdraw a tool. In addition, since the engagement movement between the holding-members is kept parallel by guide posts, misalignment of the conductors and the upper and lower holding-members is prevented during the termination operation, therefore, a better quality connector assembly can be manufactured. The number of auxiliary parts, such as rails and jigs, required by the applicator according to this invention is reduced, the press and holding members are integrated, thus the cost of manufacture is reduced and a higher operating efficiency is obtained.

I claim:

1. An electrical connector applicator for applying a cover member of an electrical connector to a base member for terminating electrical conductors to electrical contacts of the electrical connector, comprising:

base means having lower holding-means for holding the base member of the electrical connector so that the electrical conductors can be extended across the base member;

block means having upper holding-means for holding the cover member of the electrical connector;

spring-biased means movably mounted on said base means and having one section of said block means pivotally mounted thereto; and operating means pivotally mounted to said base means and having said block means pivotally mounted thereto, said operating means being operative to position said block means at a first position removed from the lower holding-means at which first position the upper holding-means has a cover member mounted thereon, position said block means at a second position adjacent the lower-holding means at which second position the cover member mounted in the upper holding-means is substantially parallel to said base member and press the cover member onto the base member resulting in the conductors being terminated to the electrical contacts to form an electrical connector assembly.

2. An electrical connector applicator as claimed in claim 1, wherein said spring-biased means comprises posts mounted on said base means and on which block members are movably mounted, where spring means extend between said block members and said base means, and said section of said block means is pivotally mounted between said block members.

3. An electrical connector applicator as claimed in claim 2, wherein said spring means comprise coil springs mounted onto said posts.

4. An electrical connector applicator as claimed in claim 1, wherein plates are mounted onto said base means, said operating means comprises a U-shaped handle having free ends thereof pivotally mounted to said plates, said handle having an arm to which said block means is pivotally mounted.

5. An electrical connector applicator as claimed in claim 4, wherein pins are located in said plates above and below where the free ends of said handle are pivotally mounted to said plates to limit movement of said handle between the first and second positions.

6. An electrical connector applicator as claimed in claim 1, wherein cutter means is provided on said upper holding-means to cut the ends of the electrical conductors that extend beyond the connector.

* * * * *